United States Patent [19]

Wolff et al.

[11] Patent Number: 4,997,144

[45] Date of Patent: Mar. 5, 1991

[54] COURSE-CORRECTION SYSTEM FOR COURSE-CORRECTABLE OBJECTS

[75] Inventors: Hendrikus J. Wolff, Hengelo; Hendrik Haverdings, Borne; Hendrik J. Zwart, Hengelo, all of Netherlands

[73] Assignee: Hollandse Signaalapparaten B.V., Hengelo, Netherlands

[21] Appl. No.: 385,611

[22] Filed: Jul. 26, 1989

[30] Foreign Application Priority Data

Aug. 2, 1988 [NL] Netherlands ..... 8801917

[51] Int. Cl.[5] ..... F41G 7/30

[52] U.S. Cl. ..... 244/3.14; 244/3.19

[58] Field of Search ..... 244/3.14, 3.19, 3.11, 244/3.13

[56] References Cited

U.S. PATENT DOCUMENTS

| | | | |
|---|---|---|---|
| 3,455,522 | 7/1969 | Galipon | 244/3.14 |
| 3,594,500 | 7/1971 | James et al. | 178/2 R |
| 3,883,091 | 5/1975 | Schaefer | 244/3.13 |
| 4,102,521 | 7/1978 | Hermann | 244/3.11 |
| 4,274,609 | 6/1981 | Ferrier et al. | 244/3.14 |
| 4,424,944 | 1/1984 | Wes et al. | 249/3.13 |
| 4,635,880 | 1/1987 | Jehle | 244/3.14 |
| 4,709,875 | 12/1987 | Cremosnik et al. | 244/3.13 |
| 4,848,208 | 7/1989 | Kosman | 89/1.11 |

*Primary Examiner*—Charles T. Jordan
*Assistant Examiner*—Richard W. Wendtland
*Attorney, Agent, or Firm*—Brian J. Wieghaus

[57] ABSTRACT

The invention relates to a course-correction system provided with a transmitting and control device 1 for wireless correction of the course of a launched object provided with a receiving device 2 by transmitting a course-correction signal containing course-correction information $C_q$ and identification codes $I_q$ for individual or collective correction of objects arranged into fixed or variable groups. The receiving device 2 of each object is thereto provided with identification parameter $P_k$ for selecting an identification code $I_{q=m}$ from the course correction signal, for which $I_{q=m}=P_k$. A fixed group is obtained by identical identification parameters $P_k$ for the objects within the group, while variable group is obtained with different identification parameters $P_k$ but identical course-correction information $C_q$ for the objects within the group. The identification parameter $P_k$ of a launched object has a known relation with the trajectory data, such as e.g. the time of lauching the object.

23 Claims, 5 Drawing Sheets

$q = 1, 2, \ldots, m, \ldots$

COURSE-CORRECTION SYSTEM FOR COURSE-CORRECTABLE OBJECTS

BACKGROUND OF THE INVENTION

The invention relates to a course-correction system for wireless correction of the course of a launched object, provided with at least one transmitting and control device which, supplied with course data of the launched object, is suitable for generating and transmitting a course-correction signal for correction of the course of the launched object and with a receiving device fitted in the object for receiving the course-correction signal and supplying at least a part of the course-correction signal to course-correction means for the purpose of executing the course correction.

The invention furthermore relates to a transmitting and control device suitable for use in such a course-correction system.

The invention furthermore relates to a receiving device suitable for use in such a course-correction system.

The invention furthermore relates to an object suitable for use in such a course-correction system.

An embodiment of such a system is known from patent application WO 83/03894. This application describes a fire control system provided with a target sensor, a fire control computer and a weapon for launching course-correctable projectiles. The fire control computer continuously calculates the expected misdistance between projectile and target on the basis of a target position measured by the target sensor and a position of a correctable projectile launched at the target, calculated by the fire control computer itself. Should this distance become too long, e.g. as a result of unexpected course changes of the target within the time of flight of the projectile, the fire control computer generates a single correction signal for a practically immediate wireless detonation of the course-correction thrusters fitted to the projectile. For this purpose, the fire control computer is provided with a transmitting and control device and the projectile is provided with a receiving device for wireless transmission of the correction signal. The instant of detonation is determined by the fire control computer itself, on the basis of orientation reference signals transmitted by the projectile, which signals are received by means of a polarized antenna located in the vicinity of the target sensor.

A disadvantage of this invention is that it is not suitable for individual course correction of several projectiles simultaneously. A transmitted correction signal is understood by all simultaneously in-flight projectiles as a correction signal intended for each individual projectile. As a result of the mutual distance along the trajectory between the projectiles, a correction signal calculated for a certain position will arrive early or late for part of the projectiles. Moreover, if these projectiles have a different orientation, a correction signal intended for a projectile having a particular orientation will have the wrong effect on another projectile with a different orientation. For projectiles spinning about their longitudinal axis, the correction system will not work in case several projectiles are in flight simultaneously. The above-mentioned disadvantages will manifest themselves in particular in case of weapon systems having high firing rates or in fire control computers provided with several weapon systems.

SUMMARY OF THE INVENTION

The present invention has for its object to provide a course-correction system whereby the above disadvantages are obviated. According to the invention, the course-correction system is for this purpose characterized in that the course-correction signal contains course-correction information and identification codes for separate correction of launched objects where an identification code is suitable for indication of the separate course-correctable objects;

the receiving device of the object is provided with a selection unit for selecting course-correction information from the course-correction signal on the basis of the identification code also contained in the course-correction signal, where the selected course-correction information is supplied to the course-correction means for executing the course correction.

The advantage achieved in this way is that, of the simultaneously in-flight objects, each object can be individually supplied with specific and optimal course-correction information.

A special embodiment of the invention is characterized in that the course-correction signal comprises an identification code $I_q$ and corresponding course-correction information $C_q$ ($q=1,2,\ldots,m-1, m, m+1,\ldots$);

the selection unit of an object k ($k=1,2,3,\ldots$) contains an identification parameter $P_k$ where the selection unit selects an identification code $I_{q=m}$ from the course-correction signal, for which $I_{q=m}=P_k$, and supplies the corresponding course-correction information $C_{q=m}$ to the course-correction means to execute the course correction.

Coupling of certain course-correction information $C_{q=m}$ with a certain identification code $I_{q=m}$ enables an object having an identification parameter $P_k=I_{q=m}$ to select this course-correction information.

By providing an identification code to the course-correction information, new possibilities are created for fire control. Objects in flight can now be corrected individually as well as collectively. In case of collective correction, the objects can be arranged into fixed or variable groups.

A course correction system enabling individual correction is characterized in that the course correction signal comprises at least r individual course-corrections ($I_q$,$C_q$) ($q=p, p+1,\ldots,p+r$);

the selection units of r successively launched objects k ($k=p, p+1,\ldots,p+r$) comprise a mutually different identification parameter $P_{k=q}=I_q$ ($q=p, p+1,\ldots,p+r$) for executing r individual course corrections.

In case the mutual distance between the r launched objects k is such that the same course correction would arrive early or late for part of the objects, this embodiment enables each object to carry out a course correction at the correct moment.

A course-correction system enabling collective correction of objects arranged into fixed groups is characterized in that the course-correction signal comprises at least one course correction ($I_O$,$C_O$) for carrying out collective course corrections of a group of r launched objects;

the selection units of r successively launched objects k respectively comprise the same identification parameter $P_k=I_O$ ($k=p, p+1,\ldots,p+r$).

For each of the objects in the group the same course correction $C_O$ is selected. If an individual course correction of objects in a group is not required, e.g. as a result of small mutual distances between the objects in the group or because of an expected inaccuracy of the individual projectile trajectories, the computing time required by the fire control computer can be reduced.

A course-correction system enabling collective correction of objects arranged into variable groups is characterized in that the course-correction signal for executing a collective course correction of a group of r launched objects k ($k=p, p+1, \ldots, p+r$), comprises r course corrections ($I_q, C_q$) ($q=p, p+1, \ldots, r$) where $C_q=C_O$ ($q=p, p+1, \ldots, p+r$);

the selection units of the group of r launched objects respectively comprise a mutually different identification parameter $P_{k=q}=I_q$ ($q=p, p+1, \ldots, p+r$).

Arrangement into groups is now achieved by coupling the same correction $C_O$ to different identification codes $I_q$. This enables for instance a temporary group to be formed by objects flying at approximately the same altitude.

The selection unit of a receiving device can be provided with an identification parameter $P_k$ in various ways and at different times. The selection unit may be provided with identification parameters through radio or wire communication, at a time before or after launching. The objects may be provided with identification parameters, either at the site of the weapon system or during production, in which case the identification parameters are to be read by the transmitting and control device.

Such an embodiment is characterized in that the transmitting and control device is suitable for successively generating r identification parameters $P_k$ ($k=p, p+1, \ldots, p+r$) which are successively supplied to a read-out unit belonging to the course-correction system;

the selection units of the r objects k are respectively provided with a read in unit for reception by means of the read-out unit of the identification parameters $P_k$, where a received identification parameter $P_k$ is stored in the selection unit of the object k ($k=p, p+1, \ldots, p+r$).

The possibility of providing the objects with an identification parameter only on the weapon system site, on the one hand provides a logistic advantage because the objects supplied can be identical and, on the other hand, an operational advantage is achieved because the arrangement in groups can take place at the last moment. In this embodiment, the arrangement in groups is determined before launching.

The assignment of the same identification parameter $P_k=I_O$ to several objects can be realized by repeating this identification parameter at a particular repetition frequency, whether or not at certain intervals. In case of an identification parameter which is coded as a signal having a particular frequency, this can be realized by generating this signal during a certain period of time.

Such an embodiment for the wireless supply of said identification parameters is characterized in that the read-out unit comprises transmitting means of the transmitting and control device where the transmitting and control device, during a certain time slot in which r objects k are successively launched, transmits at least a part of the identification parameters $P_k$;

the read-in means are constituted by the receiving means of the receiving device.

This enables an object to be provided with an identification parameter after launching.

A special embodiment for supplying identification parameters is furthermore characterized in that the read-out unit comprises means for respectively supplying at least a part of the identification parameters to the read-in units of the objects before they are launched. In case of several, simultaneously operational transmitting and control devices, an object should before launching be provided with an identification parameter characterizing the transmitting and control device corresponding with the object, enabling the selection unit to distinguish between correction signals of the various transmitting and control devices after launching.

In case of objects which have been provided with an identification code during production, such an embodiment is furthermore characterized in that the selection units of the r objects k are respectively provided with identification parameters $P_k$ ($k=p, p+1, \ldots, p+r$);

the transmitting and control device is suitable for successively reading the identification parameters $P_k$ by means of the read-out unit corresponding with the course-correction system, where the identification parameters $P_k$ are stored in the transmitting and control device for the purpose of generating the identification code $I_q$ ($q=p, p+1, \ldots, p+r$).

An advantageous embodiment is characterized in that the identification parameters $P_k$ respectively have a relation with the trajectory data of the launched objects k ($k=1, 2, 3, \ldots$) which is known at least to the transmitting and control device. The trajectory data may have been obtained by sensor measurement or by fire control computer calculation. The advantage achieved is that a course correction can be based on a particular trajectory position of an object, or be executed when the object has reached a favorable trajectory position.

In an embodiment characterized in that the objects which have been launched during a predetermined time interval, form a group, these groups have a fixed arrangement.

An embodiment characterized in that launched objects, situated in a predetermined area, form a group enables the creation of variable groups. A group may be temporarily formed by objects reaching or leaving a particular altitude.

The embodiment characterized in that said transmitting means and receiving means are also suitable for the transmission of the correction signals provides the advantage that, for transmission and reception of course-correction signals as well as identification parameters, the same transmitter and receiver in the transmitting and receiving means respectively may be used.

An identification parameter may be derived from an elapsed time of flight of an object. An embodiment suitable for this purpose is characterized in that the selection unit of an object k comprises a timer and a launching detector where the launching detector is suitable for initiating the timer at the moment a predetermined time interval after launching of object k has elapsed for the purpose of generating a time-dependent identification parameter $P_k$. The objects can now be identified on the basis of the time of flight elapsed since the instant of launching. A course-correction signal should then be provided with an identification code representing the time of flight of the object for which the correction is intended.

In an embodiment characterized in that the identification parameter $P_k$ of an object k also comprises information concerning the identity of the at least one launching means with which object k has been launched, with $k \in \{1,2, \ldots\}$, the projectiles from different launching means may be individually corrected for each launching means.

The same advantage occurs in the case of several course-correction systems in an embodiment characterized in that the identification parameter $P_k$ of the object k also comprises information concerning the identity of the at least one fire control computer by means of which the object k has been launched, with $k \in \{1,2, \ldots\}$.

In an embodiment where the object k spins about its longitudinal axis and is provided with means for determining its angular spin position with respect to a fixed predetermined reference, an advantage is obtained in that the course-correction information $C_{q=k}$ comprises information concerning an angular spin position to be assumed by object k with respect to the reference, where a course correction is to be executed with $k \in \{1,2, \ldots\}$. The advantage obtained is that in case of collective control of objects a single correction signal suffices for the entire group.

In a course-correction system according to one of the above claims, where the transmitting device is provided with target signals representing the position of one of the moving targets, an advantage is obtained in that the transmitting and control device is suitable for use in a correction system as described in one of the above claims. For longer times of flight in the case of long-distance targets or fast-maneuvering targets, this invention provides a considerable advantage, either as an addition to a fire control computer or as an integral part of the fire control computer.

BRIEF DESCRIPTION OF THE DRAWINGS

The invention will now be explained with reference to the accompanying figures, of which FIG. 1 contains schematic examples of individual and collective control of launched objects.

DESCRIPTION OF THE PREFERRED EMBODIMENT

Figure 1A:
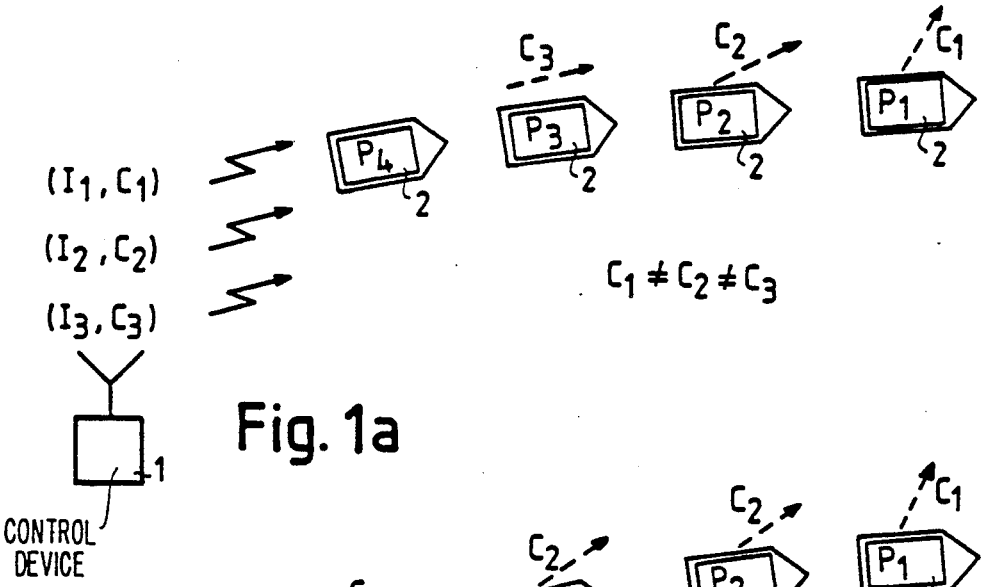
Figure 1B:
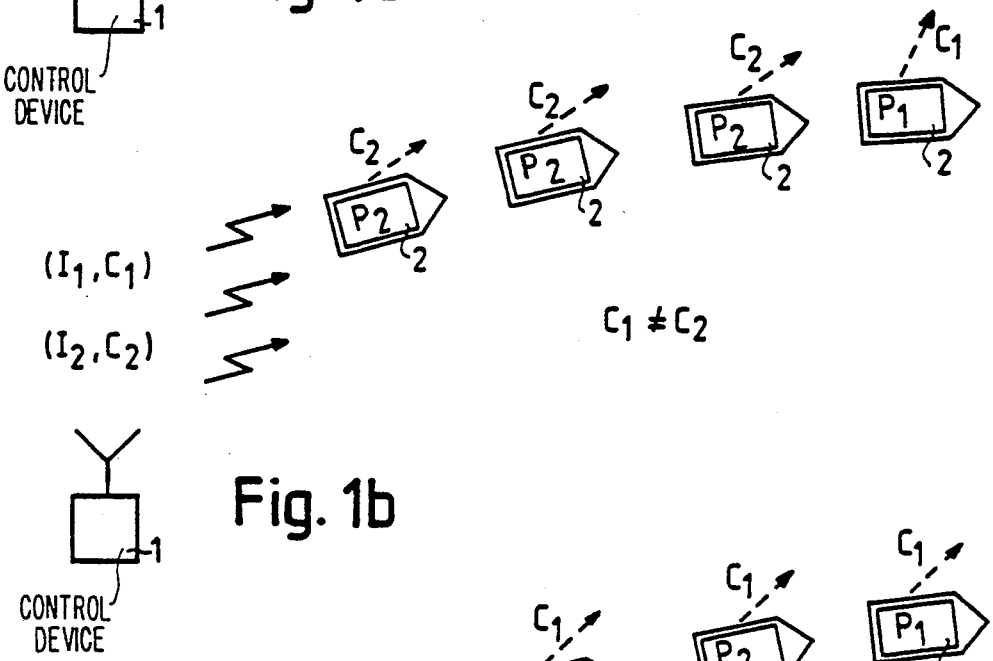
Figure 1C:
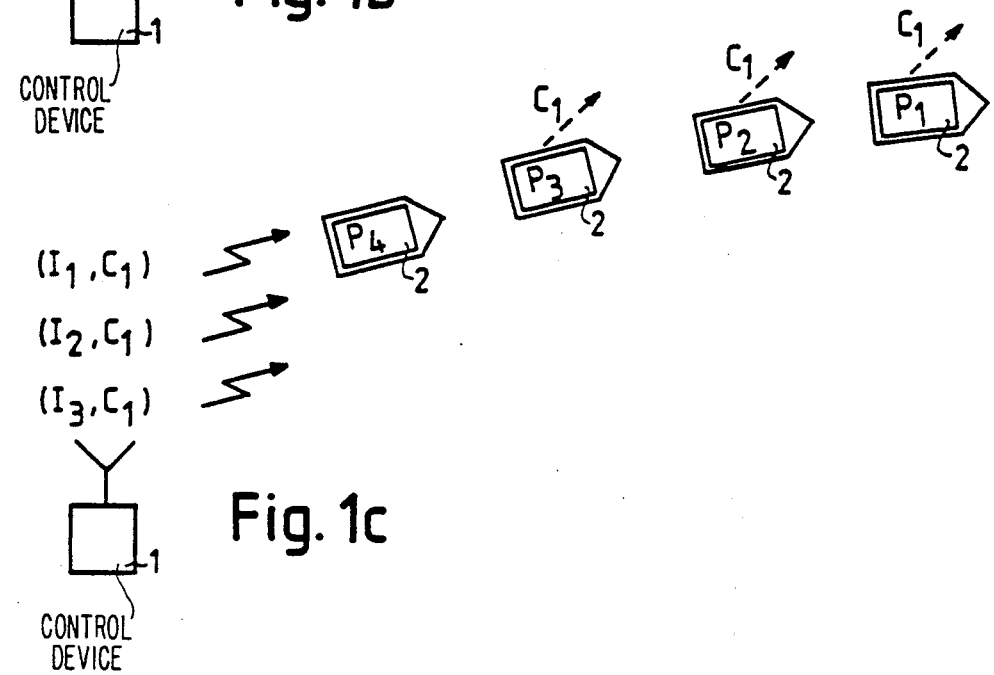

FIG. 1 illustrates a transmitting and control device 1 and a number of launched correctable objects, which objects are each provided with a receiving device 2. The transmitting and control device 1 transmits course-correction signals $(I_q, C_q)$ containing course-correction information $C_q$ with $q \in \{1,2,3\}$ and an identification code $I_q$ with $q \in \{1,2,3\}$. Each receiving device 2 is provided with an identification parameter $P_k$ with $k \in \{1,2,3,4\}$. Receiving device 2 with identification parameter $P_k$ selects from the received course-correction signals $(I_q, C_q)$ the course-correction information $C_q$ for which the corresponding identification code $I_q$ equals the identification parameter $P_k$ ($I_1=P_1$, $I_2=P_2$, $I_3=P_3$, $I_4=P_4$) FIG. 1*a* illustrates an example in which the objects each have different identification parameters $P_k$ and execute individual course corrections (individual control). FIG. 1*b* illustrates an example in which a number of objects have identical identification parameters $P_k$ and execute a collective course correction (collective control with fixed groups). FIG. 1*c* illustrates an example of objects each with different identification parameters executing a collective course correction (collective control with variable groups).

Figure 2:
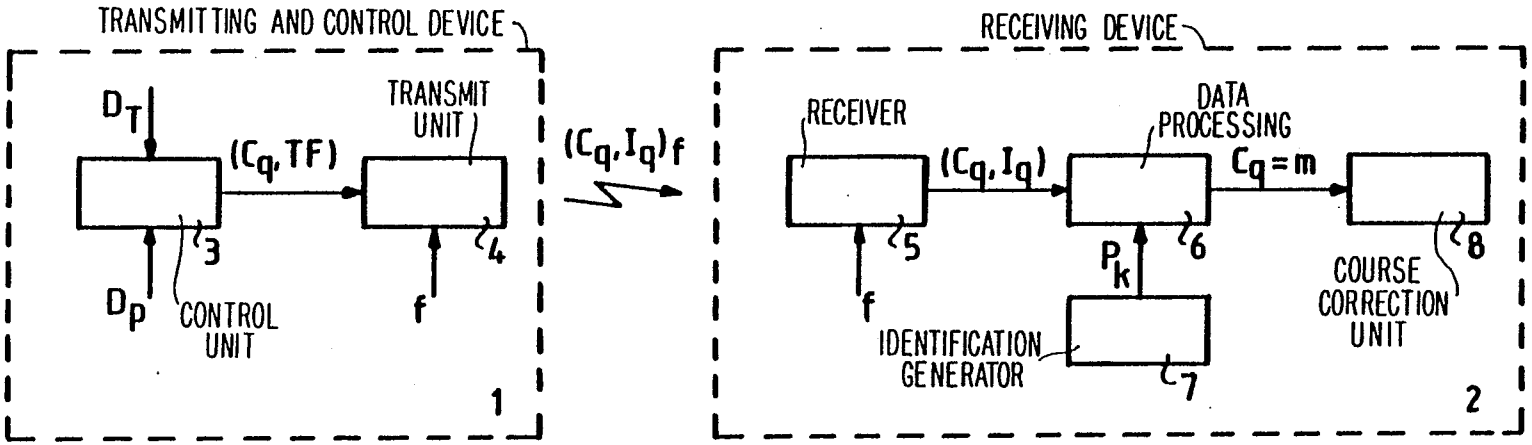
FIG. 2 shows an elementary setup of a course-correction system comprising a transmitting and control device and a receiving device.

FIG. 2 contains the most elementary elements of a course-correction system according to the invention. The transmitting and control device 1 generates and transmits signals $(C_q, I_q)_f$ containing course-correction information $C_q$ and an identification code $I_q$ for the purpose of course correction of at least one course-correctable object ($q=1, 2, \ldots, m, \ldots$), which object is fitted with receiving device 2. The transmitting and control device 1 is provided with a control unit 3 and a transmitting unit 4. On the basis of trajectory data $D_p$ supplied to control unit 3, which data relate to the correctable object, and signals $D_T$ initiating course corrections, control unit 3 generates course correction information $C_q$ for one or more actual or imaginary objects launched around a particular firing time TF. In the case of r independent corrections, q may vary from m to m+r. On the basis of firing time TF, transmitting unit 4 subsequently generates an identification code $I_q$ and transmits an rf-signal $(C_q,I_q)_f$ having a carrier-wave frequency f and containing by means of modulation this course-correction information and identification code. The transmitted correction signal $(C_q,I_q)_f$ is received by a receiver 5, tuned to frequency f. By means of demodulation, the information $(C_q,I_q)$ is subsequently derived from the course-correction signal and supplied to a data processing unit 6. This unit 6, by means of identification parameter $P_k$ generated by an identification generator 7, selects from the supplied information $(C_q,I_q)$ the correction information $C_{q=m}$ with corresponding identification code $I_{q=m}=P_k$. This correction information $C_{q=m}$ is subsequently supplied to well known course-correction means 8 with which a course correction of the object can be carried out.

The said trajectory data $D_p$ relating to the trajectory of the object may have been obtained by measurement, by calculation, or by means of a combination of both. In the case of a measurement, a sensor is required which determines the position of the object. In the case of calculation, a computer is required, such as a fire control computer for a gun system, where the fire control computer predicts, on the basis of ballistic constants, the trajectory of a non-selfpropelling projectile for the purpose of, for instance, a calculation of the gun aiming point. The trajectory data $D_p$ need not comprise a comprehensive description of the trajectory; control unit 3 may, in a particular embodiment, generate additional trajectory data on the basis of the limited trajectory data.

Signals $D_T$ may comprise information relating to a desired change of the end of the trajectory of the objects in flight. necessitating a course correction; for instance in case of long-distance artillery fire with an observer who can see the target. Signals $D_T$ may also contain information on the position of a moving target measured by a target sensor.

The identification generator 7 can have different embodiments and can in various ways be provided with an identification parameter $P_k$. For instance, identification parameter $P_k$ may be supplied to identification generator 7 before or after launching of the object. In this case, identification generator 7 should be interpreted as a memory, which at a later point in time regenerates by means of reproduction the identification parameter $P_k$ supplied earlier. In a particular embodiment, the identification generator 7 is capable of generating an identification parameter $P_k$ itself, whether or not after an externally supplied signal.

If the object has already been provided with an identification parameter $P_k$ in order to determine the relation between the parameter and the trajectory data, this parameter should be read out when the object has a known trajectory position at a known point in time, e.g. the launching instant and the launching position. If the object has not yet been provided with an identification parameter $P_k$, it should be supplied when the object has a known trajectory position at a known point in time. In this embodiment, the relation between the identification parameter $P_k$ and the trajectory data is known at least to the transmitting and control device 1, so that the course-correction information $C_q$ can be determined on the basis of a particular trajectory position at a particular point in time. As a result of this relation, at least the transmitting and control device 1 is familiar with the identification parameter $P_k$ of an object which happens to be in the vicinity of the particular trajectory position at the particular point in time. By providing the correction information $C_{q=m}$ with an identification code $I_{q=m}=P_k$ first, at a later stage the correction signal $C_{q=m}$ is selected by the projectile by means of the identification parameter $P_k$.

The identification parameter $P_k$ generated by identification generator 7 may be a constant time-independent parameter but also a parameter continuously varying with time, provided that its relation with the trajectory data is known. In the first case, identification generator 7 comprises a memory and in the second case it consists e.g. in a clock generating a signal which is proportional to the time of flight. In case of spin-stabilized projectiles, the spin velocity decrease of which is a known function of time, a signal proportional to this spin velocity may also function as an identification parameter.

Figure 3A:
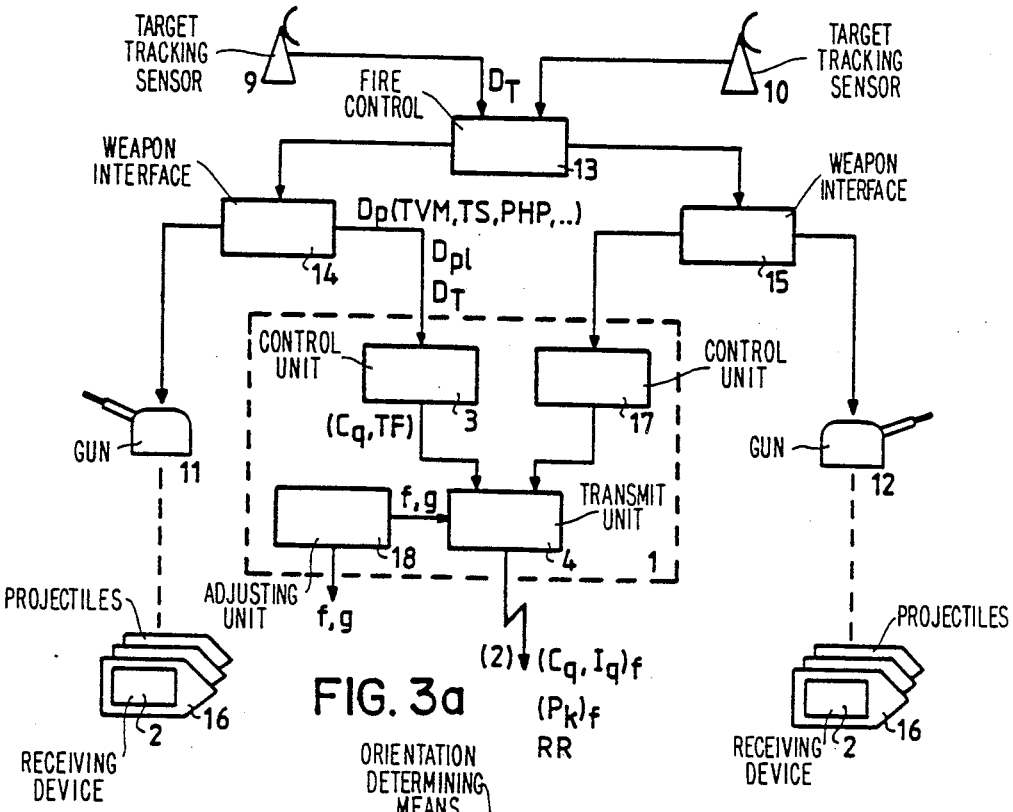
FIG. 3 shows an embodiment of a course-correction system comprising a transmitting and control device and a receiving device applied in a weapon system.
Figure 3B:
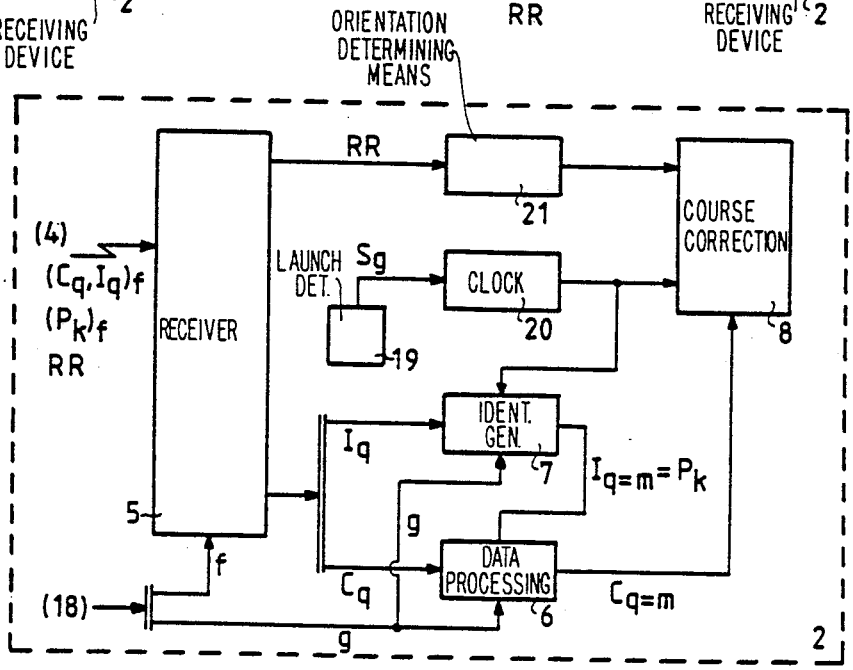

FIG. 3 illustrates an embodiment of a course-correction system according to the invention which is applied in a weapon system. The illustrated embodiment of a weapon system is suitable for tracking two targets simultaneously and for that purpose provided with two target tracking sensors 9 and 10, two guns 11 and 12 and a fire control computer 13 with two common weapon interfaces 14 and 15. The weapon system therefore comprises two fire control channels, where a fire control channel is characterized by a particular sensor-weapon combination. The target tracking sensors 9 and 10 can either be a radar tracking apparatus or an electro-optical sensor such as IR or TV camera. Target tracking sensors 9 and 10 continuously supply target signals $D_T$, relating to a current target position of a target tracked by the relevant target tracking sensor, to the fire control computer 13. Fire control computer 13 continuously generates in the customary way signals comprising information on trajectory data $D_p$ of the projectiles 16 to be fired at a target by guns 11 and 12. These trajectory data comprise predicted hitting points PHP, projectile times of flight TS and corresponding time validity moments TVM. Moreover, fire control computer 13 continuously calculates in the customary way gun control values for the purpose of aiming the guns 11 and 12. Furthermore, fire control computer 13 generates signals $D_{pl}$, comprising information on the weapon system platform (if applicable), meteorological conditions and projectile characteristics.

The embodiment of the course-correction system according to the invention illustrated in FIG. 3 is provided with transmitting and control device 1 and several identical receiving devices 2 fitted to projectiles 16. Transmitting and control device 1 is provided with two identical and independently operating control units 3 and 17. Each control unit is separately provided with signals relating to one of the fire control channels by means of fire control computer 13 via weapon interfaces 14 and 15. The signals supplied to control units 3 and 17 comprise target signals $D_T$, signals concerning the trajectory data $D_p$ of projectiles 16 and signals relating to platform data $D_{pl}$. If required, it is also possible to include signals from the guns 11 or 12 via weapon interfaces 14 and 15, or to supply signals from transmitting and control device 1 to these guns.

This weapon system does not comprise means for tracking the launched projectiles 16. The projectile trajectory data $D_p$ are obtained by calculation of the fire control computer 13. However, if position information of a projectile 16 measured by a sensor is available, this information may of course be used to check or even replace the calculated trajectory data $D_p$. control units 3 and 17 supply course-correction information $C_q$ for one or more objects launched around the same firing time TF and the corresponding firing time TF to the transmitting unit 4 for the purpose of generating identification codes $I_q$ and transmission of course-correction signals $(C_q,I_q)_f$, comprising this course-correction information and identification code, at an r.f. carrier-wave frequency f. In this embodiment, transmitting unit 4 also generates and transmits identification parameter signals $(P_k)_f$ comprising identification parameters $P_k$ for the purpose of supplying these parameters to receiving units 2. Furthermore, transmitting unit 4 in this embodiment also generates and transmits the orientation reference signals RR, on the basis of which projectiles 16 can determine an orientation with respect to a reference coordinate system.

The transmitting and control device 1 is further provided with adjusting means 18 for the purpose of supplying information g identifying guns 11 and 12 and information f identifying fire control computer 13 to transmitting unit 4 as well as to receiving device 2. The identification parameter $P_k$, generated by control units 3 and 17, is subsequently provided with information g with which the gun is identified. Fire control computer 13 is identified by the adjusted carrier-wave frequency f at which the correction signals are transmitted. Transmitting unit 4 can be adjusted to a number of different frequencies.

Besides the said receiver 5, receiving device 2 is provided with a launching detector 19 in the form of an acceleration detector, a clock 20, identification generator 7 in the form of an identification memory, data processing unit 6, orientation determination means 21, and course-correction means 8 to execute course corrections. Acceleration detector 19 generates, at a certain point in time after the occurrence of a particular acceleration as a result of the launching of the projectile, a trigger signal $S_g$ for clock 20. The time elapsed after that point in time, recorded by clock 20, practically corresponds with an elapsed time of flight of the relevant projectile. When this time of flight has exceeded a certain value, identification generator 7 is enabled, by means of signals originating from clock 20, to store the identification parameter $P_{k=m}$, represented by the next signal $(P_{k=m})_f$, from the identification parameter signals $(P_k)_f$ (k=1,2,3, . . . m . . . ), continuously received by receiver 5. Once identification memory 7 has been provided with identification parameter $P_{k=m}$, the next identification parameters $P_k$ are generated. Before launching, data processing unit 6 in receiving device 2 has already been provided, by means of adjusting means 18, with gun and fire control computer identification information f and g. On the basis of the identification parameter $P_k$, stored in identification memory 7, data processing unit 6 selects from the received course-correction signals $(C_q, I_q)$ the course-correction information $C_{q=m}$ which is coupled to identification code $I_{q=m}=P_k$.

The course-correction information $C_{q=m}$ is subsequently supplied to correction means 8 with which course-corrections can be executed. This can be realized in the customary way by means of small thrusters mounted on the periphery of the projectile, or by changing the orientation of the adjustable control fins fitted to the projectile. In order to determine the proper time of correction, correction means 8 are provided with signals representing the orientation of the object to be corrected. These signals are generated by the orientation determination unit 21 on the basis of orientation reference signals RR transmitted by transmitting unit 4 and received by receiver 5.

In the embodiment described, the projectiles rotate about their longitudinal axis, where course corrections are executed by means of small thrusters. The orientation in this case applies to an angular spin position of the correctable object about the longitudinal axis of the projectile. The angular spin position determination may be carried out in the customary way as described in patent specification EP-A 0.239.156. The stabilized omni-antenna for transmission of orientation reference signals RR is in this embodiment also used as an antenna for transmitting the correction and identification assignment signals.

Correction means 8 are furthermore supplied with the signal, generated by clock 20, representing the elapsed time of flight. The correction-information $C_{q=m}$ supplied to correction means 8 comprises a course correction direction c, the number of thrusters to be detonated NC, and a first point in time TC for executing the correction. On the basis of these signals and information supplied to correction means 8, the correction means calculate for each available thruster the point in time at which the thruster reaches the optimal an8ular spin position for the required course correction. The thruster for which this point in time most approximates the first point in time TC is selected and detonated when a thruster has reached the correct angular spin position, taking into account reaction times for data processing and detonation.

The embodiment of a course-correction system as illustrated in FIG. 3 can be added to an existing weapon system without requiring drastic changes to the weapon system. In the case of an integrated design of a fire control computer and a course-correction system according to the invention, the fire control computer may of course comprise one or more parts of the course-correction system.

Figure 4:
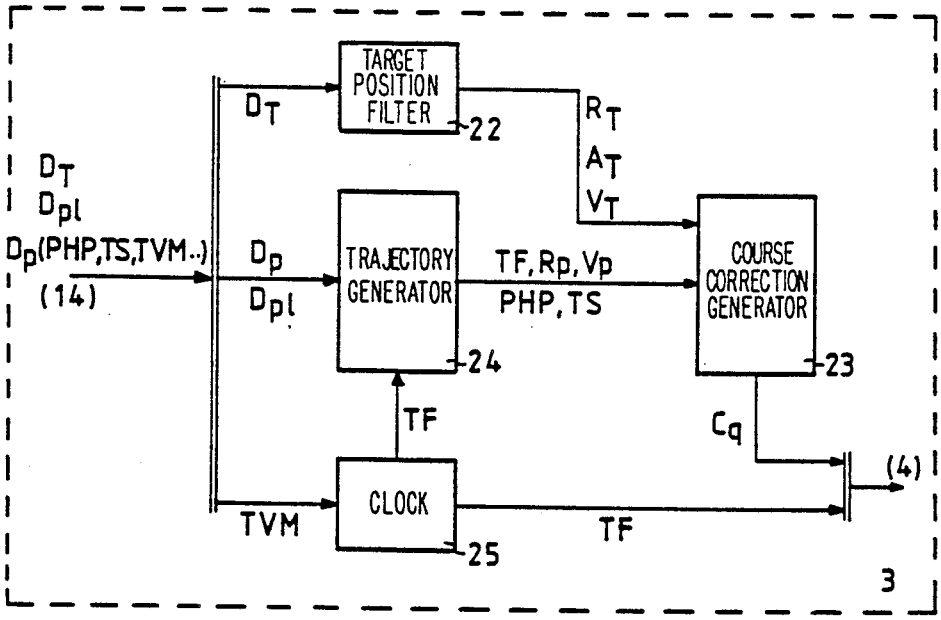
FIG. 4 shows an embodiment of a control unit of the transmitting and control device of FIG. 3.

FIG. 4 illustrates an embodiment of control unit 3 which is suitable for use in the transmitting and control device 1 of FIG. 3. Via weapon interface 11 indicated in FIG. 3, control unit 3 is provided with target information $D_T$, trajectory data $D_p$ and platform information $D_{pl}$. Target position filter 22 filters position data RT comprised in $D_T$ and supplies this data, together with information comprising the target velocity $V_T$, target acceleration $A_T$, and target and target trajectory parameters, to a course-correction generator 23, where these data are used in the compilation of any course correction information $C_q$.

The platform data $D_{pl}$ and projectile trajectory data $D_p$ are supplied to a trajectory generator 24. This trajectory generator 24 supplies the information relating to a projectile trajectory, which is required for the generation of course corrections by correction generator 23. Since fire control computer 13 in this application already generates trajectory data $D_p$ in the form of end points (PHP, TS) and starting points (platform position and speed), trajectory generator 24 may carry out a simpler calculation than the one carried out by the fire control computer. Trajectory generator 24 calculates a projectile position $R_p$ and a projectile velocity $V_p$ corresponding with an imaginative firing time TF. For that purpose, the platform data comprise the platform's own velocity and own course information.

For subsequent generation of these firing times TF, a clock 25 is fitted which, on the basis of supplied time validity information TVM concerning the trajectory data $D_p$, synchronizes the calculations of the trajectory generator 24 with these time validity moments TVM. The time validity moments TVM may then be interpreted as imaginary firing times TF at which imaginary projectiles are fired and for which course corrections are calculated if applicable.

At a later stage, transmitting unit 4 (FIG. 3) supplies an identification parameter $P_k$, based on the imaginary projectile trajectory corresponding with a certain firing time TF, to all projectiles actually fired during a particular time slot around that firing time TF. This imaginary projectile trajectory is characterized by the projectile velocity $V_p$, the projectile position $R_p$, the hitting point PHP and the time of flight TS corresponding with this firing time TF.

The data relating to the projectile trajectory $R_p$, $V_p$, PHP and TS, together with the firing time TF, are supplied to course-correction generator 23, which compiles the course-correction information $C_q$. The signals representing the firing times TF, generated by clock 25, are supplied to transmitting unit 4 (FIG. 3) together with course-correction information $C_q$ generated by the course-correction generator 23.

Figure 5:
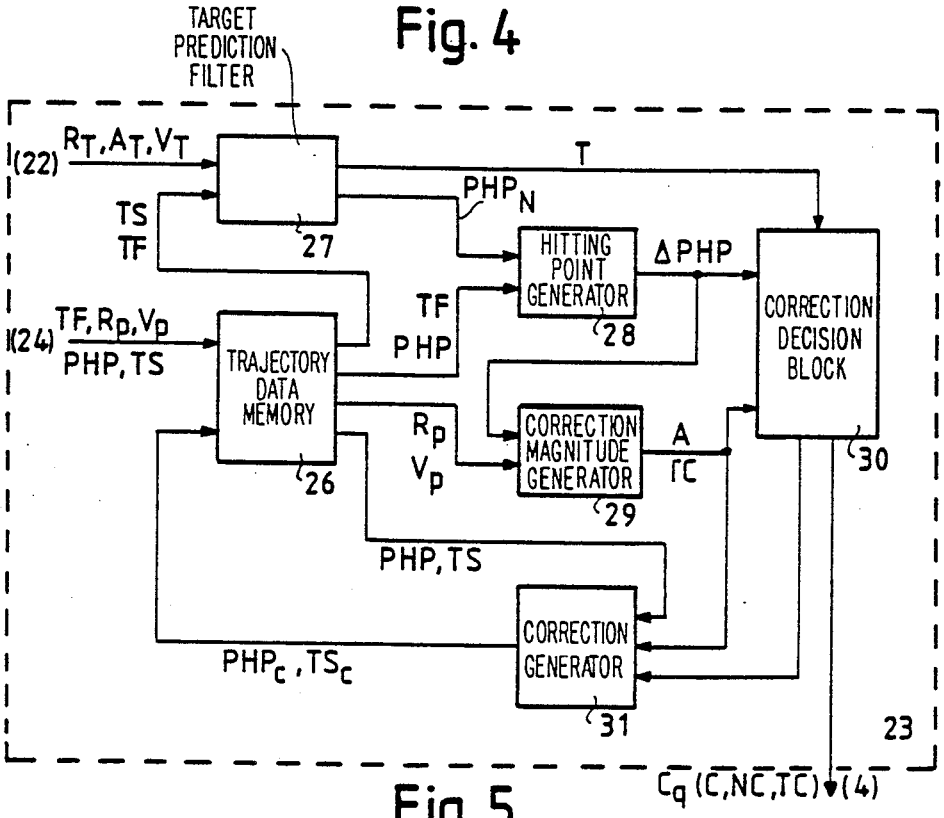
FIG. 5 shows an embodiment of a correction generator of the control unit of FIG. 4.

FIG. 5 illustrates an embodiment of course-correction generator 23 of FIG. 4. Course-correction generator 23 is provided with a trajectory data memory 26 in which the trajectory data TF, $R_p$, $V_p$, PHP and TS, generated by trajectory generator 24 (FIG. 4), are stored. Whenever new target data $R_T$, $V_T$ and $A_T$, generated by target position filter 22 (FIG. 4), become available, a new target position $PHP_N$ is calculated by the prediction filter 27 for the remaining part of the time of flight of each (imaginary) projectile of which the trajectory data are stored in the trajectory data memory 26 and of which the time of flight has not expired. For this purpose, prediction filter 27 is provided with target data $R_T$, $V_T$ and $A_T$ generated by target position filter 22 (FIG. 4), and with the firing times TF and times of flight TS stored in trajectory data memory 26. The advantage of a separate prediction filter 27, besides a similar filter in the fire control computer 13, is that for prediction of times shorter than the total time of flight TS. optimal values may be selected for the filter parameters.

Subsequently, the difference ΔPHP is calculated (block 28) between the new target position $PHP_N$ calculated for the remaining time of flight by the prediction filter 27 and the hitting point PHP for the relevant (imaginary) projectile stored in trajectory data memory 26. ΔPHP can be understood to be a required hitting point adaptation to ensure that the projectile hits the target. Moreover, the magnitude A of any course correction at time TC is calculated (block 29) on the basis of the projectile position $R_p$ and velocity $V_p$ of the relevant imaginary projectile stored in trajectory data memory 26. Allowances are made for the results of any earlier corrections of the relevant projectile, such as the number of thrusters available and the loss of mass resulting from earlier detonation of one or more thrusters. The calculated magnitude A of any correction at time TC is expressed by the shift of the given hitting point PHP as a result of the correction.

In determining the time TC for execution of the correction, allowance is made for the expected processing reaction times before a correction is actually executed.

On the basis of data T also generated by prediction filter 27, relating to the type of target and target trajectory, the required hitting point change ΔPHP and the magnitude A of a course correction for an imaginary projectile, a decision is made (block 30) on whether the correction should actually be carried out. Besides, the number of thrusters NC required for the calculated hitting point change ΔPHP is determined; NC thrusters to be detonated result in a total hitting point change of NC×A. The direction C of any course correction is derived from the direction of the required hitting point change ΔPHP. If a decision is made to carry out a correction, new corrected values for the hitting point PHP and the time of flight TS stored in trajectory data memory 26 are calculated (block 31) on the basis of the magnitude A (block 29) and the direction C (block 30) of the correction. The corrected hitting point $PHP_c$ and the corrected time of flight $TS_c$ are subsequently stored in the trajectory data memory 26 and thus replace the previously stored hitting point and hitting time corresponding with the imaginary projectile characterized by firing time TF.

By storing the changed trajectory data resulting from a first correction, the first correction is automatically taken into account in the calculation of the effect of a second correction.

Figure 6:
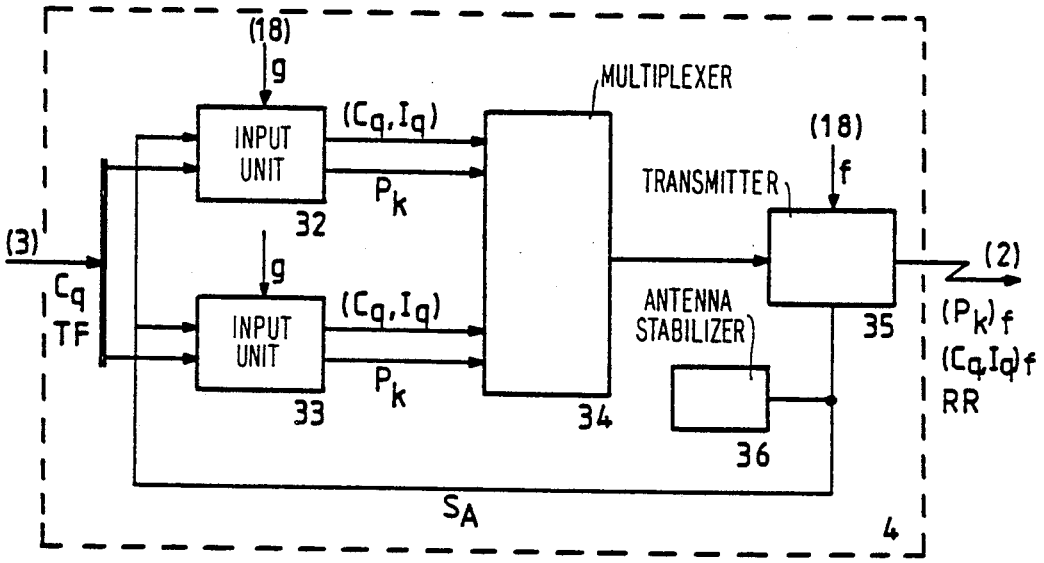
FIG. 6 shows an embodiment of a transmitting unit of the transmitting and control device of FIG. 3.

FIG. 6 illustrates an embodiment of transmitting unit 4 of FIG. 3. It is provided with two identical input units 32 and 33 for the purpose of two control units 3 and 17 of FIG. 3 for the two different fire control channels of the weapon system. On the basis of the firing instances TF, input units 32 and 33 generate the identification code $I_q$ and the corresponding identification parameter. The identification cods $I_q$ and the identification parameter $P_k$ are also provided with information g relating to the gun. Furthermore, the control units provide the course-correction information $C_q$ with the corresponding identification code $I_q$. Input units 32 and 33 are also supplied with signals $S_A$ containing information relating to the orientation of the antenna transmitting the orientation reference signals RR. In this embodiment, this is the same antenna with which the correction and identification parameter signals are transmitted. The signals representing the orientation $S_A$ are derived from stabilization unit 36, stabilizing this antenna in the reference coordination system in which the course-correction direction c is indicated. By means of this information, the supplied course-correction direction C is corrected for the antenna orientation with respect to this reference coordinate system.

Control units 32 and 33 supply the information $(C_q,I_q)$ and $P_k$, on the basis of which transmitter 35 generates the course-correction signals $(C_q,I_q)_f$ and identification parameter signals $(P_k)_f$, to multiplexer 34 which ensures an organized supply of these signals to transmitter 35. In this embodiment, the transmitter is provided with one transmission channel characterized by a carrier-wave frequency f. This frequency is adjusted by means of adjusting means 18 of the transmitting and control device 1 (FIG. 3).

Figure 7:
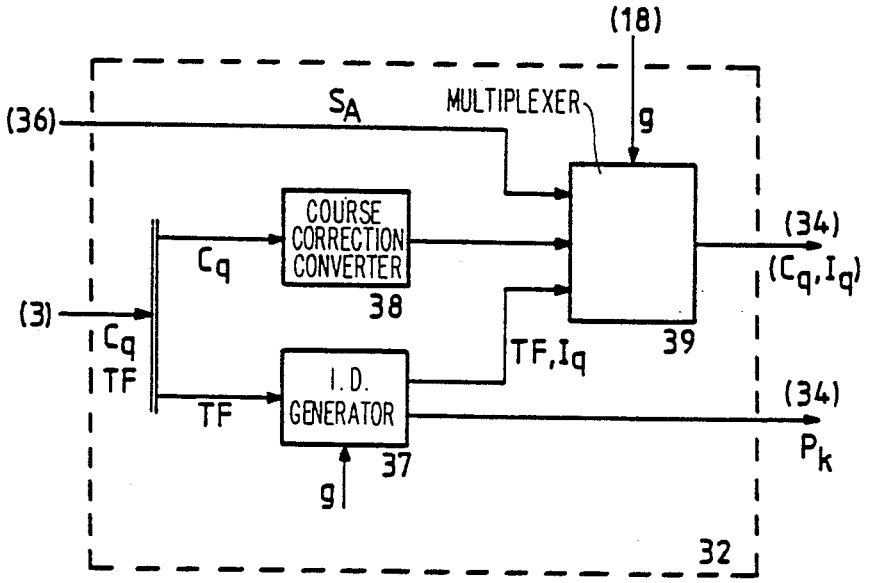
FIG. 7 shows an embodiment of the input unit of the transmitting unit of FIG. 6.

FIG. 7 illustrates an embodiment of input unit 32 of FIG. 6. At each firing time TF an identification parameter $P_k$ corresponding with this time is generated (block 37). This code is supplied to multiplexer 34 (FIG. 6) for the purpose of compiling the identification parameter signal $(P_k)_f$. The time delay in the receiving unit 2 (FIG. 3) is such that each projectile fired by the gun within a certain time slot around firing time TF, is supplied with the same identification parameter $P_k$ by means of identification parameter signal $(P_k)_f$, at a time later than TF. The course-correction direction C is, by means of data P relating to the projectile direction, converted to a course-correction direction C' with respect to the direction of the projectile (block 38). The resulting course-correction information $C_q$ is stored in a stack (block 38). The stored information is retrieved from the stack on a first-in, first-out basis, where the information relating to the firing time TF is replaced (block 30) by an identification code $I_q$ corresponding with this time, matching the identification parameter $P_k$ (block 37) previously generated for this time.

Moreover, the identification code $I_q$ and the identification parameter $P_k$ are provided with gun identification information g by means of a signal originating from adjusting means 18 (block 39 and 37).

We claim:

1. Course-correction system for wireless correction of the course of launched objects, said system comprising control means for generating and transmitting a course correction signal from course data of the launched objects for correcting the course of the launched objects, and receiving means disposed in each launched object for receiving the course correction signal and supplying at least a part of the course-correction signal to course-correction means in the launched objects for executing the course correction, characterized in that:

the course-correction signal contains course-correction information (q=1, 2, 3 . . . ) and identification codes Iq (q=1, 2, 3 . . . ) for separate correction of groups of launched objects where an identification code is suitable for indication of the separate groups of course-correctable objects;

said receiving means comprising an identification parameter $P_k$ (k=1, 2, 3 . . . ) and selection means for selecting course-correction information from the course-correction signal on the basis of the identification codes Iq (q=1, 2, 3 . . . ) contained in the course-correction signal, in each object said receiving means supplying the selected group course-correction information to the course-correction means for executing the course correction.

2. Course-correction system as claimed in claim 1, characterized in that the course-correction signal comprises at least one course correction ($I_O$,$C_O$) for carrying out collective course corrections of a group of r launched objects;

said selection means of r successively launched objects k respectively comprise the same identification parameter $P_k=I_O$ (k=P, P+1, . . . , p+r).

3. Course-correction system as claimed in claim 1, characterized in that the course-correction signal for executing a collective course correction of a group of r launched objects k (k=p, p+1, . . . , p+r), comprises r course corrections ($I_q$,$C_q$) (q=p, p+1, . . . , r) where $C_q=C_O$ (q=p , p+1, . . . , p+r);

said selection means of the group of r launched objects respectively comprise a mutually different identification parameter $P_{k=q}=I_q$ (q=p, p+1, . . . , p+r).

4. Course-correction system as claimed in claim 3, wherein said system further comprises a read-out means for transmitting identification parameters to the launched objects, characterized in that said control means successively generates r identification parameters $P_k$ (k−p, p+1, . . . , p+r) which are successively supplied to said read-out means; and said selection means of the r objects k are respectively provided with a read-in means for receiving by means of said read-out means the identification parameters $P_k$, where a received identification parameter $P_k$ is stored in said selection means of the object k (k=p, p+1, . . . , p+r).

5. Course-correction system as claimed in claim 4, characterized in that said read-out means comprises transmitting means of said control means and said control means during a certain time slot in which r objects k are successively launched, transmits at least a part of the identification parameters $P_k$; and said read-in means are constituted by said receiving means.

6. Course-correction system as claimed in claim 5, characterized in that said read-out means comprises means for respectively supplying at least a part of the identification parameters to the read-in means of the objects before they are launched.

7. Course-correction system as claimed in claim 3, characterized in that said selection means of the r objects k are respectively provided with identification parameters $P_k$ (k=p, p+1, . . . , p+r);

the control means successively reads the identification parameters $P_k$ by means of said read-out means corresponding with the course-correction system, and said control means stores the identification parameters $P_k$ for the purpose of generating the identification code $I_q$ (q=p, p+1, . . . , p+r).

8. Course-correction system as claimed in claim 1 characterized in that the identification parameters $P_k$ respectively have a relation with the course data of the launched objects k (k=1, 2, 3, . . . ) which is known at least to the control means.

9. Course-correction system as claimed in claim 2, characterized in that the objects which have been launched during a predetermined time interval, form a group, these groups have a fixed arrangement.

10. Course-correction system as claimed in claim 3, characterized in that launched objects, situated in a predetermined area, form a group.

11. Course-correction system as claimed in claim 5, characterized in that said transmitting means and receiving means are also suitable for the transmission of the correction signals.

12. Course-correction system as claimed in claim 3, characterized in that the selection unit of an object k comprises a timer and a launching detector where the launching detector is suitable for initiating said timer at the moment a predetermined time interval after launching of object k has elapsed for the purpose of generating a time dependent identification parameter $P_k$.

13. Course-correction system as claimed in claim 1, characterized in that the identification parameter $P_k$ of an object k also comprises information concerning the identity of the at least one launching means with which object k has been launched, with k ϵ {1,2, . . . }.

14. Course-correction system as claimed in claim 1, characterized in that the identification parameter $P_k$ of the object k also comprises information concerning the identity of the at least one fire control computer by means of which the object k has been launched, with k ϵ {1,2, . . . }.

15. Course-correction system as claimed in claim 1, where the object k spins about its longitudinal axis and is provided with means for determining its angular spin position with respect to a fixed predetermined reference, characterized in that the course-correction information $C_{q=k}$ comprises information concerning an angular spin position to be assumed by object k with respect to the reference, where a course correction is to be executed with k ϵ {1,2, . . . }.

16. Course-correction system as claimed in claim 1, where the control means is provided with target signals representing the position of a target, characterized in that, on the basis of target signals, the control means generates course-correction signals comprising such course correction information to direct launched objects towards the target.

17. Course-correction system as claimed in claim 4, characterized in that said read-out means comprises means for respectively supplying at least a part of the identification parameters to said read-in means of the objects before they are launched.

18. Course-correction system as claimed in claim 2, wherein said system further comprises a read-out means for transmitting identification parameters to the launched objects, characterized in that said control means successively generates r identification parameters $P_k$ (k−p, p+1, . . . , p+r) which are successively supplied to said read-out unit; and said selection means of the r objects k are respectively provided with a read-in means for receiving by means of said read-out means the identification parameters $P_k$, where a received identification parameter $P_k$ is stored in said selection means of the object k (k=p, p+1, . . . , p+r).

19. Course-correction system as claimed in claim 1, wherein said system further comprises a read-out means for transmitting identification parameters to the launched objects, characterized in that said control means successively generates r identification parameters $P_k$ (k−p, p+1, . . . , p+r) which are successively supplied to said read-out means; and said selection means of the r objects k are respectively provided with a read-in means for receiving by means of said read-out means the identification parameters $P_k$, where a received identification parameter $P_k$ is stored in said selection means of the object k (k=p, p+1, . . . , (p+r).

20. Course-correction system as claimed in claim 2, characterized in that said selection means of the r objects k are respectively provided with identification parameters $P_k$ (k=p, p+1, . . . , p+r);

the control means successively reads the identification parameters $P_k$ by means of said read-out means corresponding with the course-correction system, and said control means stores the identification parameters $P_k$ for the purpose of generating the identification code $I_q$ (q=p, p+1, . . . , p+r).

21. Course-correction system as claimed in claim 1, characterized in that said selection means of the r objects k are respectively provided with identification parameters $P_k$ (k=p, p+1, . . . , p+r);

the control means successively reads the identification parameters $P_k$ by means of said read-out means corresponding with the course-correction system, and said control means stores the identification parameters $P_k$ for the purpose of generating the identification code $I_q$ (q=p, p+1, . . . , p+r).

22. A course-correction system for wireless correction of the course of launched objects, said system comprising control means for generating and transmitting a course correction signal from course data of the launched objects for correcting the course of the launched objects, and receiving means disposed in each launched object for receiving the course correction signal and supplying at least a part of the course-correction signal to course-correction means in the launched objects for executing the course-correction, characterized in that:

said system further comprising a read-out means for transmitting identification parameters $P_k$ to the objects;

the course-correction signal comprises at least r individual course-corrections ($I_q$,$C_q$) (q=p, p+1, . . . , p+r) and identification codes Iq (q=1, 2, 3, . . . ) for separate correction of launched objects, the identification codes being suitable for indication of a separate course-correctable objects;

each receiving means comprises a selection means for selecting course-correction information from the course-correction signal on the basis of the identification codes Iq contained in the course-correction signal, in each launched object said receiving means supplying the course-correction information to said course-correction means for executing the course correction, the selection means of r successively launched objects k (k=p, p+1, . . . , p+r) comprising mutually different identification parameter $P_{k=q}=I_q$ (q=p, p+1, . . . , p+r) for executing r individual course-corrections;

said control means successively generating r identification parameters $P_k$ (k=p, p+1, . . . , p+r) which are successively supplied to said read-out means; and the selection means of the r objects k each comprise a read-in means for receiving from the read-out means the identification parameter $P_k$, where received identification parameter $P_k$ is stored in the selection unit of the object k (k=p, p+1, . . . , p+r).

23. A course-correction system for wireless correction of the course of launched objects, said system comprising control means for generating and transmitting a course correction signal from course data of the launched objects for correcting the course of the launched objects, and receiving means disposed in each launched object for receiving the course correction signal and supplying at least a part of the course-correction signal to course-correction means in the launched objects for executing the course-correction, characterized in that:

said system further comprising a read-out means for transmitting identification parameters $P_k$ to the objects;

the course-correction signal comprises at least r individual course-corrections ($I_q$, $C_q$) (q=p, p+1, . . . , p+r) and identification codes Iq (q=1, 2, 3 . . . ) for separate correction of launched objects, said identification codes Iq being suitable for indication of separate course-correctable objects;

each receiving means comprises a selection means for selecting course-correction information from the course-correction signal on the basis of the identification codes Iq contained in the course-correction signal, said receiving means supplying the course-correction information to the course-correction means for executing the course correction, the selection means of r successively launched objects k (k=p, p+1, . . . , p+r) comprising mutually different identification parameter $P_{k=q}=I_q$ (q=p, p+1, . . . , p+r) for executing r individual course-corrections;

the selection means of the r objects k are respectively provided with identification parameters $p_k$ (k=p, p+1, . . . , p+r); and the control means successively reads the identification parameters $p_k$ from said read-out means, and said control means stores the identification parameters $p_k$ for generating said identification codes Iq (q=p, p+1, . . . p+r).

* * * * *